US011661736B2

(12) United States Patent
Rosan

(10) Patent No.: US 11,661,736 B2
(45) **Date of Patent: *May 30, 2023**

(54) MODULAR WALL PANELS AND SYSTEM

(71) Applicant: Versare Solutions LLC, Minneapolis, MN (US)

(72) Inventor: Arnon Rosan, New York, NY (US)

(73) Assignee: Versare Solutions LLC, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/494,154

(22) Filed: Oct. 5, 2021

(65) Prior Publication Data

US 2022/0025645 A1 Jan. 27, 2022

Related U.S. Application Data

(63) Continuation of application No. 16/242,742, filed on Jan. 8, 2019, now Pat. No. 11,174,632.

(51) Int. Cl.
*E04B 2/14* (2006.01)
*E04C 2/08* (2006.01)
(Continued)

(52) U.S. Cl.
CPC ..... *E04B 2/14* (2013.01); *E04C 2/08* (2013.01); *E04C 2/14* (2013.01); *E04C 2/18* (2013.01); *E04C 2/205* (2013.01); *E04C 2/22* (2013.01)

(58) Field of Classification Search
CPC ..... E04B 1/34321; E04B 2/14; E04B 2/30; E04B 2002/7461; E04B 2/74;
(Continued)

(56) References Cited

U.S. PATENT DOCUMENTS 1,344,803 A 6/1920 Lannert
1,400,709 A 12/1921 Worthington
(Continued)

OTHER PUBLICATIONS

Best-Rite Fabric Standard Modular Panel, 6'×5', Gray; Dec. 7, 2018 (7 pages); https://www.staples.com/Best-Rite-Fabric-Standard-Modular-Panel-6x5-Gary/product_302619.
(Continued)

*Primary Examiner* — Brian E Glessner
*Assistant Examiner* — James J Buckle, Jr.
(74) *Attorney, Agent, or Firm* — Metz Lewis Brodman Must O'Keefe LLC

(57) ABSTRACT

Modular wall panels having a frame of a plurality of frame components and at least one wall sheet affixed to the frame. The frame components may have angled ends, straight ends, or a combination thereof to collectively form a frame which may include corners. Each frame component includes an outer surface with at least one aperture configured to receive and retain an insert therein. The apertures are also configured to permit a cable(s) to pass therethrough for running cables and such through the interior of the wall panel. Connectors and spacers may be inserted into the apertures as inserts and bridge between adjacent panels to selectively connect the panels. Caps may be placed in empty apertures to cover the openings for aesthetic purposes. A wall system includes a plurality of such wall panels connected to one another along the outer surfaces of the frame components of their respective frames.

9 Claims, 12 Drawing Sheets

(51) Int. Cl.

| | |
|---|---|
| ***E04C 2/14*** | (2006.01) |
| ***E04C 2/22*** | (2006.01) |
| ***E04C 2/18*** | (2006.01) |
| ***E04C 2/20*** | (2006.01) |

(58) Field of Classification Search

CPC ..... E04F 15/02417; E04F 15/02452; E04F 15/02458; E04F 2201/0107; E04F 2201/0115; E04C 1/24; E06B 1/00; E06B 1/04; E06B 3/00

USPC ..... 52/204.1

See application file for complete search history.

(56) References Cited

U.S. PATENT DOCUMENTS

| | | | |
|---|---|---|---|
| 1,550,606 | A | 8/1925 | Dale et al. |
| 2,153,913 | A | 4/1939 | Owen |
| 2,392,552 | A | 1/1946 | Roe |
| 3,292,331 | A | 12/1966 | Sams |
| 3,305,982 | A | 2/1967 | Murphy |
| 3,327,440 | A | 6/1967 | Watkins |
| 3,382,632 | A | 5/1968 | Grofcsik |
| 4,118,903 | A | 10/1978 | Coulthard |
| 4,191,001 | A | 3/1980 | L'heureux |
| 4,249,336 | A | 2/1981 | Moe et al. |
| 4,262,463 | A | 4/1981 | Hapel |
| 4,547,331 | A | 10/1985 | Batstra |
| 4,949,519 | A | 8/1990 | Jeffers |
| 4,996,811 | A | 3/1991 | Dull et al. |
| 5,163,259 | A | 11/1992 | Hunsaker et al. |
| 5,187,908 | A | 2/1993 | Losensky |
| 5,285,607 | A | 2/1994 | Somerville |
| 5,292,189 | A | 3/1994 | Lau et al. |
| 5,339,798 | A | 8/1994 | Christian |
| 5,519,971 | A | 5/1996 | Ramirez |
| 5,720,138 | A | 2/1998 | Johnson |
| 5,724,782 | A | 3/1998 | Rice |
| 5,826,394 | A | 10/1998 | Barton, Jr. et al. |
| 5,826,395 | A | 10/1998 | Weaver |
| D403,028 | S | 12/1998 | Barton, Jr. et al. |
| 5,842,276 | A | 12/1998 | Asher et al. |
| D410,704 | S | 6/1999 | Krog |
| 5,921,046 | A | 7/1999 | Hammond, Jr. |
| 5,921,047 | A | 7/1999 | Walker |
| 6,088,987 | A | 7/2000 | Simmons et al. |
| 6,105,330 | A | 8/2000 | Nanayakkara |
| 6,115,977 | A | 9/2000 | Hornberger et al. |
| 6,138,426 | A | 10/2000 | Mork |
| 6,167,665 | B1 | 1/2001 | Dame et al. |
| 6,202,381 | B1 | 3/2001 | Dame et al. |
| 6,209,273 | B1 | 4/2001 | Jeffers et al. |
| 6,223,485 | B1 | 5/2001 | Beck et al. |
| 6,336,298 | B1 | 1/2002 | Chou |
| 6,550,208 | B2 | 4/2003 | Nanayakkara |
| 6,571,525 | B2 | 6/2003 | Coleman |
| 6,609,336 | B2 | 8/2003 | Matsubara |
| 6,729,085 | B2 | 5/2004 | Newhouse |
| 6,983,569 | B1 | 1/2006 | Rosenberg |
| 7,127,856 | B2 | 10/2006 | Hagen, Jr. et al. |
| 7,168,216 | B2 | 1/2007 | Hagen, Jr. |
| 7,185,460 | B2 | 3/2007 | Corden |
| 7,562,500 | B2 | 7/2009 | Siu |
| 7,603,821 | B2 | 10/2009 | Eberlein et al. |
| 7,850,390 | B2 | 12/2010 | Lisbona |
| 8,046,962 | B2 | 11/2011 | Glick et al. |
| D686,676 | S | 7/2013 | Telford |
| 8,695,304 | B2 | 4/2014 | Robinson |
| 8,800,230 | B2 | 8/2014 | O'Connor |
| 8,887,459 | B2 | 11/2014 | Wheeler |
| 9,032,682 | B2 | 5/2015 | Knoll et al. |
| 9,187,895 | B2 | 11/2015 | Rodriguez Carassus |
| D783,731 | S | 4/2017 | Rosan |
| D786,586 | S | 5/2017 | Rosan |
| D791,885 | S | 7/2017 | Rosan |
| D800,846 | S | 10/2017 | Rosan |
| D809,162 | S | 1/2018 | Rosan |
| 10,010,805 | B2 | 7/2018 | Maxam |
| 10,167,632 | B2 | 1/2019 | Maxam |
| 10,196,826 | B1 | 2/2019 | Rosan |
| D862,202 | S | 10/2019 | Niu |
| 10,683,661 | B2 | 6/2020 | Bigelow et al. |
| 2004/0211127 | A1 | 10/2004 | Wiechecki et al. |
| 2006/0137277 | A1 | 6/2006 | Katwyk et al. |
| 2008/0222979 | A1 | 9/2008 | Rissmiller |
| 2009/0049788 | A1 | 2/2009 | Thorpe |
| 2009/0113836 | A1 | 5/2009 | Pitchers et al. |
| 2009/0173027 | A1 | 7/2009 | Bennett |
| 2009/0188188 | A1 | 7/2009 | Rivet |
| 2010/0186326 | A1 | 7/2010 | Cummings et al. |
| 2010/0270299 | A1 | 10/2010 | Baltussen et al. |
| 2010/0325989 | A1 | 12/2010 | Leahy |
| 2011/0099929 | A1 | 5/2011 | Liegeois et al. |
| 2011/0146180 | A1 | 6/2011 | Klein |
| 2011/0225909 | A1 | 9/2011 | Rodriguez Carassus |
| 2013/0019541 | A1 | 1/2013 | Lin |
| 2014/0033631 | A1 | 2/2014 | Rokk et al. |
| 2014/0053481 | A1 | 2/2014 | Leahy |
| 2014/0090325 | A1 | 4/2014 | Maeers |
| 2015/0143763 | A1 | 5/2015 | Gosling |
| 2015/0197935 | A1 | 7/2015 | Gosling et al. |
| 2016/0017653 | A1 | 1/2016 | Bottin |
| 2016/0237707 | A1 | 8/2016 | Maxam |
| 2017/0306610 | A1 | 10/2017 | Leahy |
| 2018/0300433 | A1 | 10/2018 | Maxam et al. |
| 2019/0010691 | A1 | 1/2019 | Moran et al. |

OTHER PUBLICATIONS

United States Patent and Trademark Office; Office Action; Office Action from U.S. Appl. No. 16/573,258; pp. 1-16; publisher United States Patent and Trademark Office; published Alexandria, Virginia, USA; copyright and dated Feb. 4, 2020; copy enclosed (16 pages).

International Searching Authority; International Search Report and Written Opinion of the International Searching Authority; International Application No. PCT/US2019/068555; Patent Cooperation Treaty; pp. 1-13; publisher United States International Searching Authority; Published Alexandria, Virginia, US; copyright and dated Feb. 28, 2020; copy enclosed (13 pages).

United States Patent and Trademark Office; Office Action; Office Action regarding U.S. Appl. No. 16/573,258; pp. 16, publisher United States Patent and Trademark Office; published Alexandria, Virginia, USA; copyright and dated Aug. 11, 2020; copy enclosed (16 pages).

International Searching Authority; International Search Report and Written Opinion of the International Searching Authority; International Application No. PCTUS2020/050991; Patent Cooperation Treaty; pp. 1-9; publisher United States International Searching Authority; Published Alexandria, Virginia, US; copyright and dated Oct. 21, 2020; copy enclosed (9 pages).

United States Patent and Trademark Office; Office Action; Office Action regarding U.S. Appl. No. 16/573,258; pp. 6, publisher United States Patent and Trademark Office; published Alexandria, Virginia, USA; copyright, and dated Dec. 2, 2020 copy; enclosed (6 pages).

MODULAR WALL PANELS AND SYSTEM

CLAIM OF PRIORITY

This application is a continuation of co-pending U.S. patent application Ser. No. 16/242,742, filed Jan. 8, 2019, the content of which is incorporated herein by reference in its entirety.

FIELD OF THE INVENTION

This invention relates to wall systems, and more particularly, to modular wall panel system frame components for assembling the exterior frames of a customizable wall system.

BACKGROUND

Temporary walls are needed in many settings, such as for events like exhibitions, trade shows, and festivals. Such temporary walls need to be easy to assemble and disassemble and also easy to transport. Current modular wall offerings are made of sheetrock or plywood and are therefore quite heavy and cumbersome to transport, often requiring multiple people or trips to transport to a site. This makes them difficult to use if there is only one person transporting and setting up the walls, or if there are many other items being transported as well, such as merchandise or supplies. Existing modular walls often require affixing one to another with hinges or connection hardware that requires tools to assemble or connect and disconnect. A person must therefore also transport tools for assembly, adding to the weight and bulk of materials being transported. Their cumbersome nature also makes existing wall panels difficult to alter once installed, such as updating, repositioning, and changing configurations. They are difficult to use and are limited in their functionality and customization. For instance, they may only attach a certain number of ways and do not stack on one another for height variation or extension.

What is needed therefore is a wall system that can be quickly and easily assembled and disassembled for ease of use. Lighter weight walls would also be beneficial to make transportation easier, but they still need to be structurally sound. These two aspects are at odds with one another. A fully customizable temporary wall system is still lacking in the art, and one which can be customized not only to size and configuration but aesthetically as well to a variety of different palates.

SUMMARY

A modular wall system and panels are disclosed which address the above needs. Specifically, the modular wall system and wall panels of the present invention are lightweight, being made of lightweight material and having a substantially hollow interior to provide even lighter construction. The construction is structurally sound despite this light weight, each wall panel including a frame made of a plurality of frame components collectively supporting the wall panel from within. Wall sheets are mounted to the frame on at least one side, but preferably both sides to sandwich the frame between wall sheets made of lightweight material. The frame components making up the frame themselves are substantially hollow, having a plurality of apertures extending therethrough to allow access to the interior of the wall panel. However, the frame components also include support ribs in the walls and may include at least one divider to separate the interior space of the frame component and provide additional structural support. Further support is provided by inserting cap(s) and/or connector(s) into the apertures of the frame components.

Because the frame components forming the frame of each wall panel include a plurality of apertures, each wall panel may be connected to any other wall panel through the apertures in their outer edges. For example, at least one bi-directional connector may be received in an aperture of one wall panel and an aperture of an adjacent wall panel. Any number of connectors may be used with the apertures in the frame components to connect adjacent wall panels. Planar connectors may also be used to bridge between adjacent wall panels, inserting into the apertures of adjacent wall panels while spanning over the outer surface of the panels. Caps may be inserted into unused apertures to conceal the openings for aesthetics.

The wall panels may come in any size, shape and dimension for increased customization to fit any size space and desired configuration. The wall panels may also include a feature, such as a window, door or other structure within the boundaries of the panel, such as to provide for designs, logos, indicia, backlighting, and other design features as may be desired. The lightweight yet structurally sound design of the wall panels allows them to be combined in any number of ways, including stacked vertically on one another and intersecting at 90° angles to form joining walls. No tools are necessary, as the caps and connectors are simply inserted to assemble and may be removed by pulling to release.

Because of these features, the modular wall panels and system as described herein provides numerous options for different aesthetics, easier and faster assembly and disassembly without the need for tools, and the ability to run cables through the interior of the wall panels and system for power, connectivity, lighting, Internet and the like without having to sacrifice aesthetics. They may be used for any type of wall where customization or temporary walls may be used, such as but not limited to office walls, cubicles, wall dividers, apartments, trade shows, art exhibits, fairs, festivals and events.

The modular wall panels and system, together with their particular features and advantages, will become more apparent from the following detailed description and with reference to the appended drawings.

DESCRIPTION OF THE DRAWINGS

Like reference numerals refer to like parts throughout the several views of the drawings.

DETAILED DESCRIPTION

As shown in the accompanying drawings, the present invention is directed to modular wall panels and a wall system made thereof. The present modular wall panels and system are extremely lightweight. They provide minimal material and lightweight materials to increase mobility in the field for ease of transportation and use. The modular wall panels may be connected in any number of configurations as described in greater detail below to achieve a fully customizable system that a user can assemble to their own specifications. For example, the modular wall panels and system described herein may be used in a variety of settings, such as but not limited to office walls, cubicles, wall dividers, apartments, trade shows, art exhibits, fairs, festivals and events. The modular wall panels are also capable of having cables run through their interior, such as power cables for various lighting and devices, Internet, and other cables or wires as may be necessary for electronic connectivity and yet remain concealed for aesthetic purposes. The modular wall panels make for easy and customizable assembly, as well as quick disassembly, changing or updating as needs or desires dictate.

The modular wall panels described herein may be interoperable and used with any of the blocks, interfacing members, and floor panels as shown and described in U.S. Pat. Nos. D791885, D809162, D786586, D783731 and D800846, and U.S. patent application Ser. No. 29/640,623 and U.S. Ser. No. 15/954,391, all of which are incorporated by reference herein.

Figure 1:
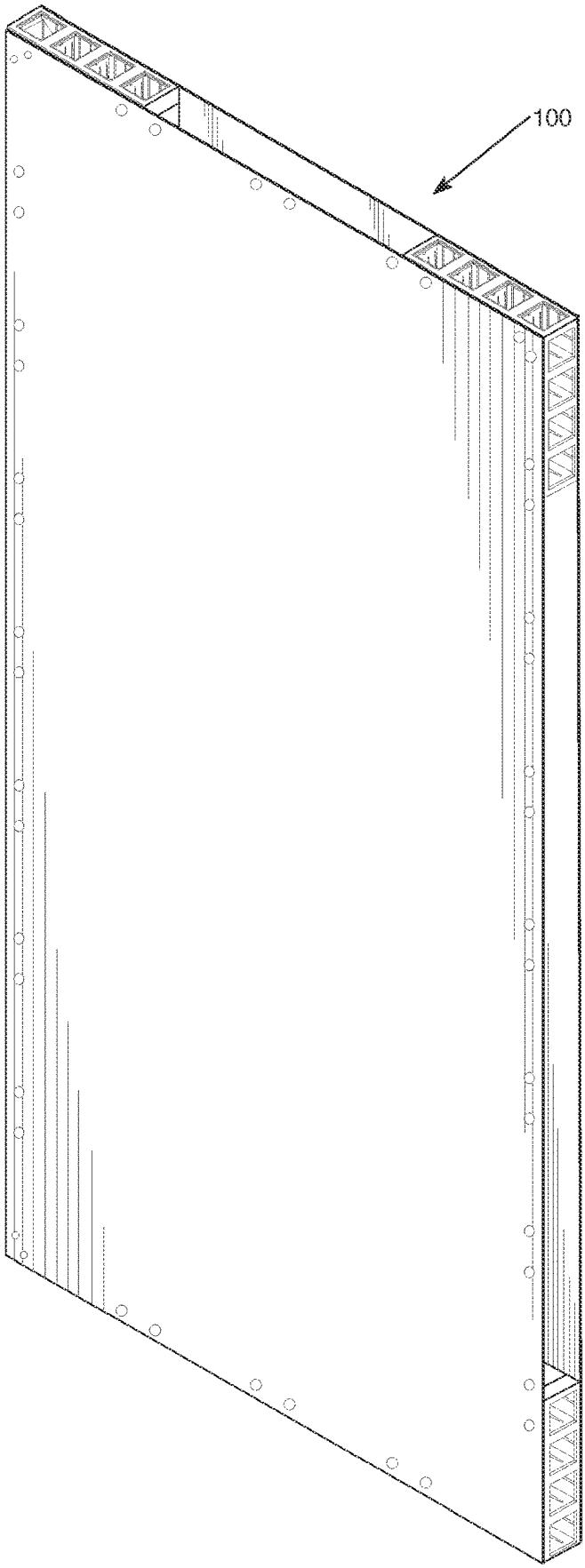
FIG. 1 is an isometric view of one exemplary embodiment of a modular wall panel of the present invention.
Figure 2:
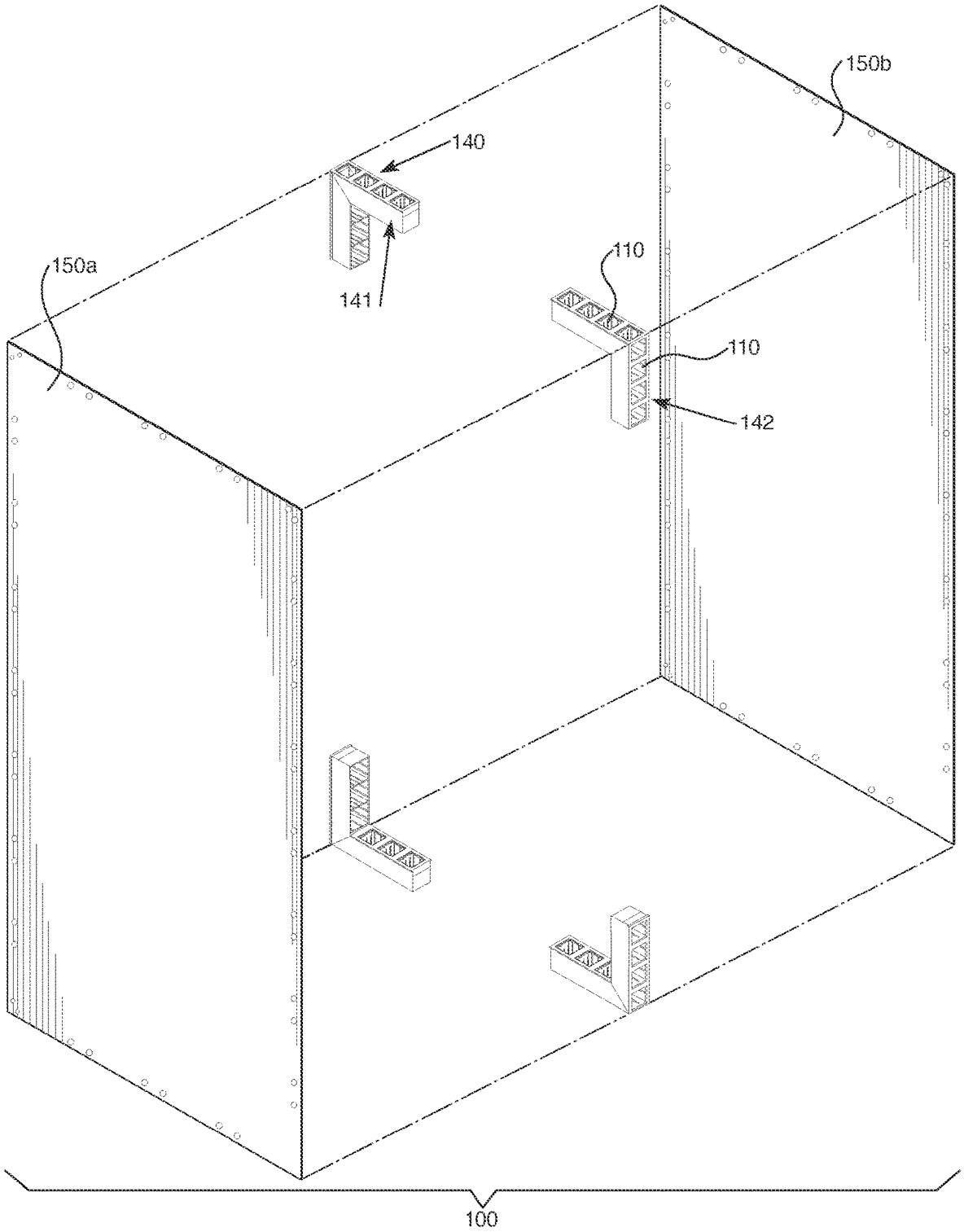
FIG. 2 is an exploded view of the modular wall panel of FIG. 1.

With reference now the Figures, the present invention is directed to modular wall panels 100 that may be connected to one another to form a modular and customizable wall system 200. As shown in FIGS. 1-2, each modular wall panel 100 is composed of at least one wall sheet 150 secured to a frame 140 made up of a plurality of frame components 110. The wall sheet 150 may be made of any lightweight material and may be flexible or rigid. For example, the wall sheet 150 may be made of materials such as but not limited to paper, fabric, wood, vinyl, fiberboard, fiberglass, fiberglass reinforced panel (FRP), styrofoam, polyvinyl chloride (PVC), expanded PVC, foam, polystyrene, polyurethane, polypropylene, acrylic, cardboard, carbon fiber, balsa, plastic, polymeric material, titanium, steel, stainless steel, magnesium, aluminum, zinc, carbon steel and metal alloys. In at least one embodiment, the wall panels 150 may be made of FRP which provides not only structural integrity in a lightweight material but is also fire retardant. In such embodiments, the wall panels 100 can be assembled into a wall system 200 that can act as a fire wall, such as may be useful in basements and garages where firewalls may be a desired safety precaution or mandated by building codes. The present wall system 200 can therefore be used to create a firewall to supplement existing walls without having to tear down and rebuild walls to code.

Figure 9:
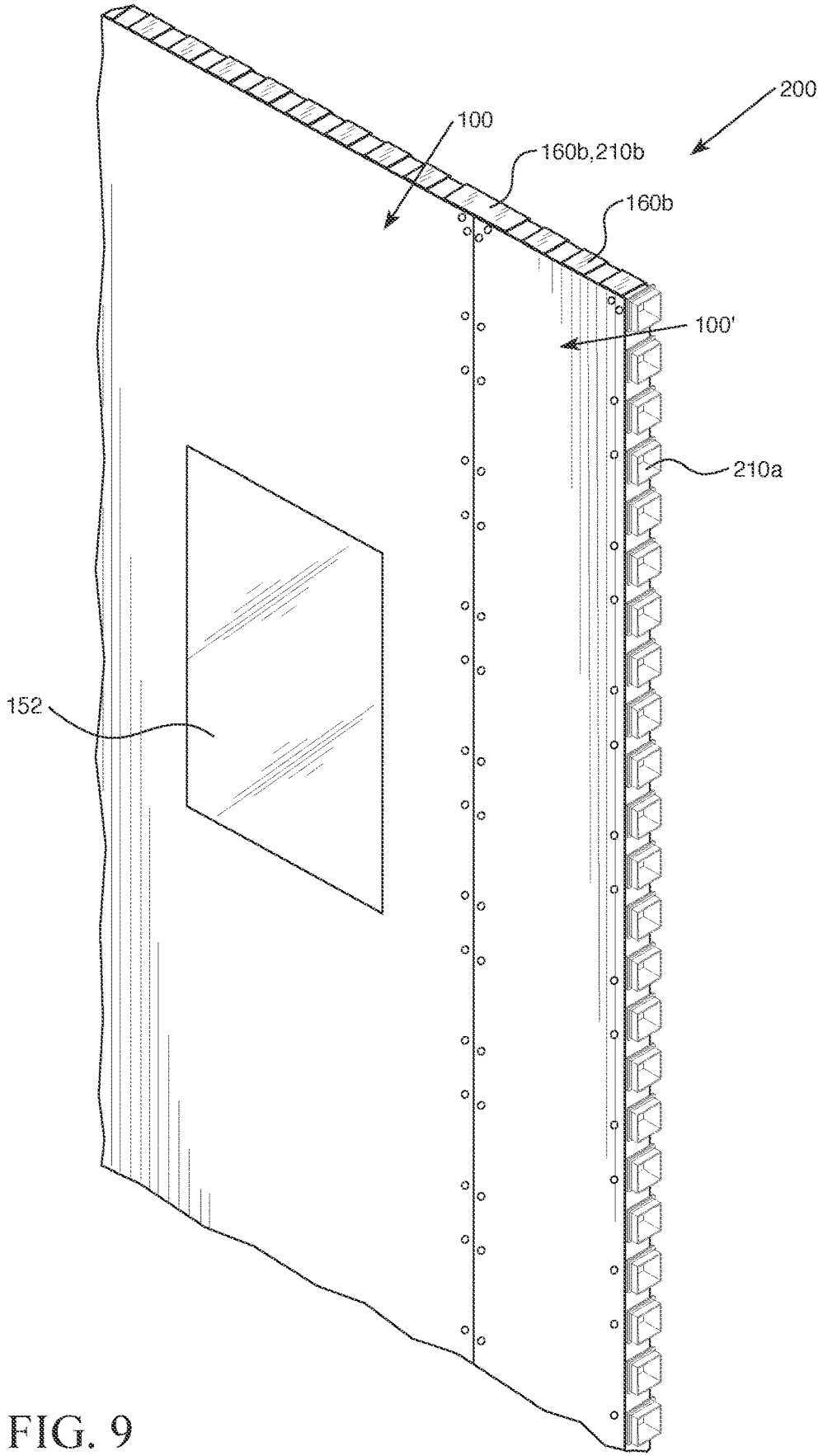
FIG. 9 is a partial isometric view of one embodiment of the modular wall system of the present invention.

The material comprising the wall sheets 150 may be of any color, design, or combination thereof. For instance, the wall sheets 150 may be a solid color or may be a combination of colors in a pattern or design. Artwork, logos, branding indicia, and other markings may also be present on the wall sheets 150. In some embodiments, the wall sheet 150 may include a feature 152, such as depicted in FIG. 9. The feature 152 may be a window, door, mesh screen or other similar structure interrupting or differing from the surface of the wall sheet 150. The feature 152 may be transparent, translucent or opaque. For instance, a transparent feature 152 such as a window may be useful in revealing items behind it (i.e., within the wall panel 100) such as lighting. Accordingly, in at least one embodiment, the feature 152 may be backlit with colored or white lights, such as LEDs, to create a lighting effect, ambiance or desired aesthetic. The feature 152 may be translucent or opaque so as to set off design elements, such as but not limited to logos for advertising or custom designs. The feature 152 may be made of the same or different material as the wall sheet 150, such as acrylic, vinyl or other material. In other embodiments, the feature 152 may be an optical or display screen, such as an LCD or other similar screen suitable for displaying moving images thereon, and which may be touch-enabled for interactive display. The display screen feature 152 may be in electrical communication with a processor and/or computing device configured to receive, process and display visual information on the screen. It may also be in electrical communication with speakers to provide audio information as well, which may be presented simultaneously with the video. It may further be in electrical communication with the Internet, cloud, and/or a network such as available through WiFi, Bluetooth® or direct communication.

Figure 3:
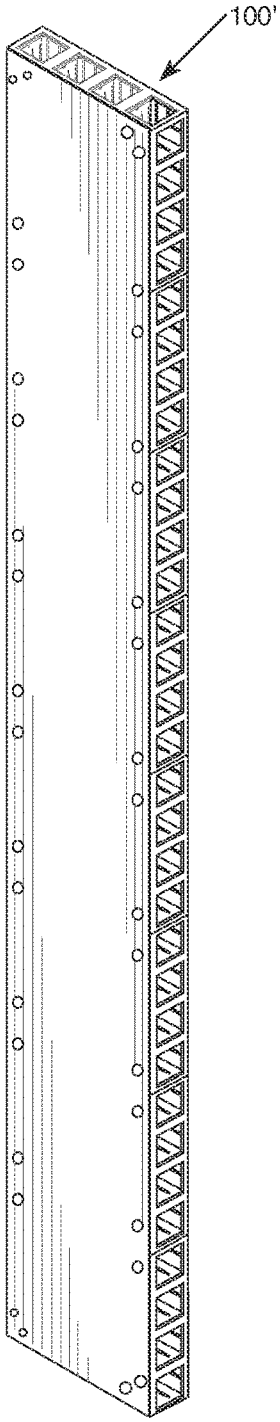
FIG. 3 is an isometric view of a second exemplary embodiment of a modular wall panel of the present invention.
Figure 4:
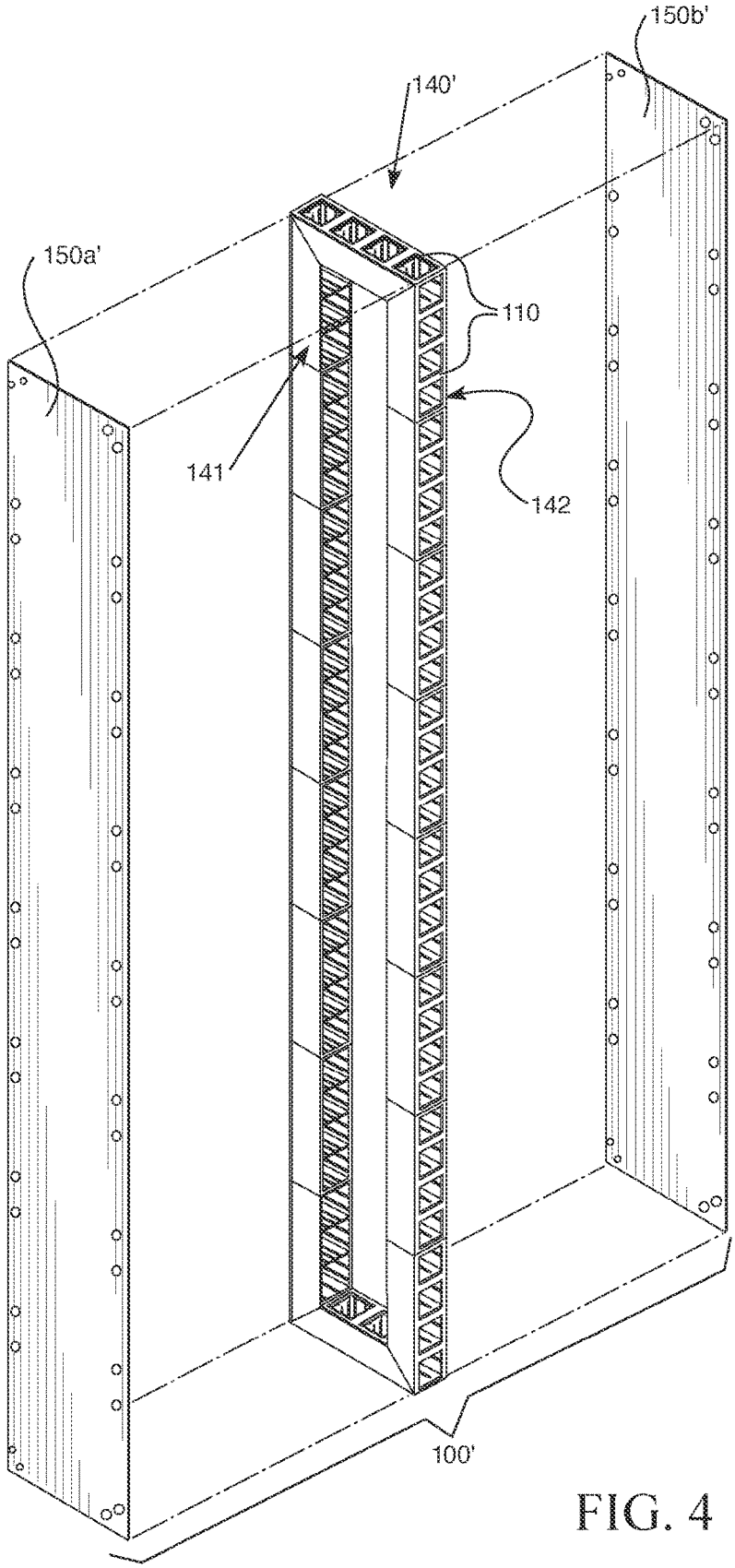
FIG. 4 is an exploded view of the modular wall panel of FIG. 3.

The wall panels 100 may be of any shape, such as but not limited to square and rectangular. They may also be any size and dimension. The particular shape, size and dimension of each wall panel 100 may be based, at least in part, on the geometry and/or size of the frame 140 which supports it. For example, a modular wall panel 100 may have a generally rectangular configuration and may be about 4 ft by 8 ft, as in FIGS. 1 and 2, or may be about 1 ft by 8 ft as in FIGS. 3 and 4. These are non-limiting examples for illustrative purposes only. The dimensions of the modular wall panels 100 may vary in increments of 1 foot, 6 inches, or other suitable increment as permitted by the shape and size of the frame components 110.

In forming the wall panel 100, wall sheets 150 are affixed to a face of the frame 140. For instance, as seen in FIG. 2, a first wall sheet 150*a* is affixed to a first face 141 of a frame 140, and a second wall sheet 150*b* is affixed to a second face 142 of the frame 140. Similarly, in FIG. 4, a narrower first wall sheet 150*a*' is affixed to a first face 141 of a frame 140', and a second wall sheet 150*b*' is affixed to a second face 142 of the frame 140' to form a narrower wall panel 100'. The wall sheets 150*a*, 150*b* may be affixed to the face of the frame 140 by any means, such as but not limited to by rivets, screws, bolts, adhesive, welding, hook and loop fasteners, and combinations thereof. Accordingly, the wall sheets 150*a*, 150*b* may be affixed to the face of the frame 140 by permanent or selective fastening. In at least one embodiment, the wall sheets 150*a*, 150*b* are permanently affixed to the frame 140 such as at a manufacturer's facility and are provided to end users as wall panels 100. In other embodiments, the frame 140 and wall sheets 150*a*, 150*b* may be provided separately to the end user and the end user may assemble the wall panel 100 to their own liking in the field, which may be changed later if desired.

Figure 10:
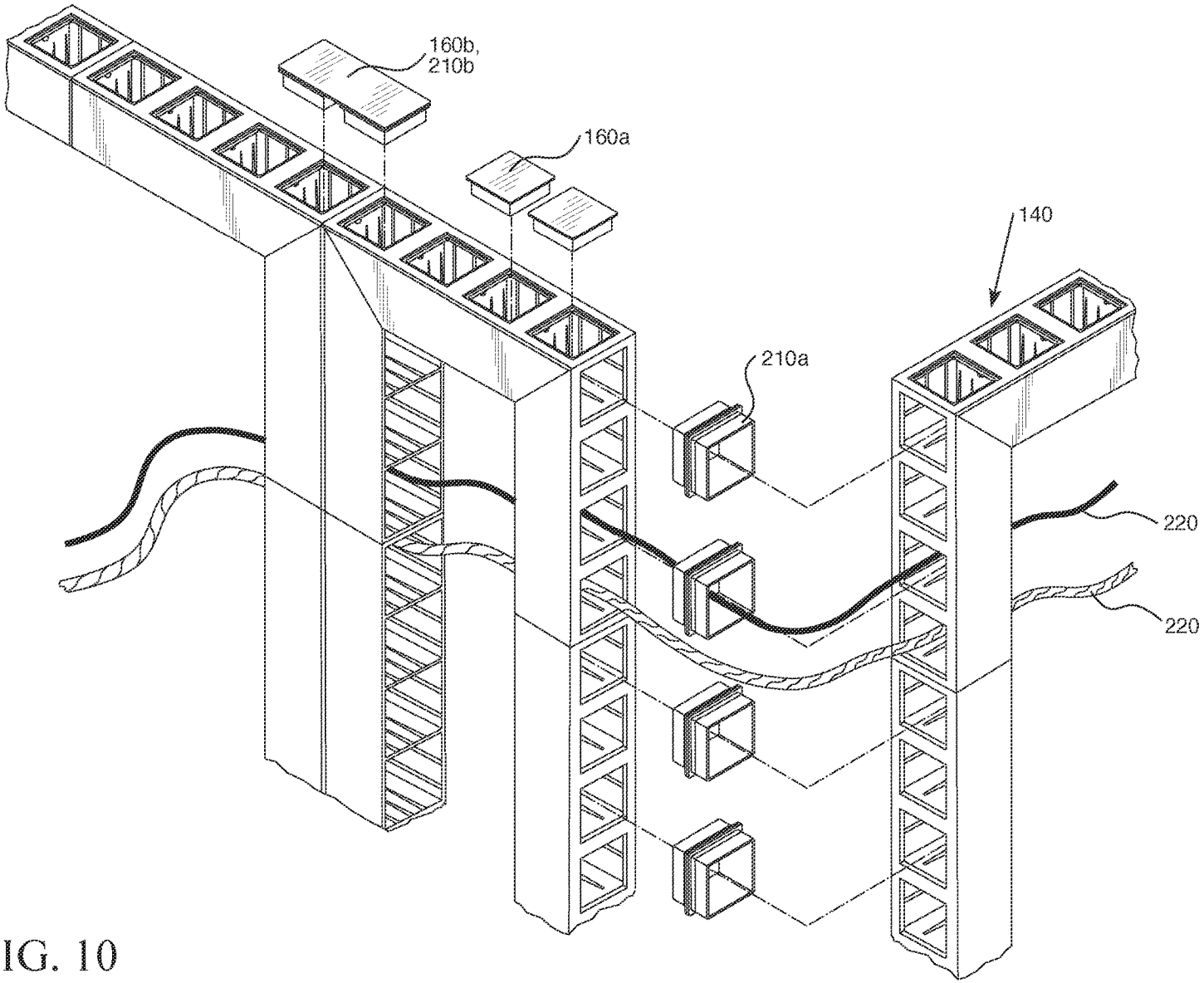
FIG. 10 is a partially exploded view of a portion of a modular wall system demonstrating connection of adjacent walls.

Different types of wall sheets 150*a*, 150*b*, such as of different materials or different configurations, may be affixed to the different faces 141, 142 of the frame 140. In other embodiments, the wall sheets 150*a*, 150*b* on either side of the frame 140 may be of the same type. In some embodiments, multiple wall sheets 150 may be affixed to the same face 141, 142 of the frame 140, such as when combining multiple smaller wall sheets 150 to fill a frame 140. Multiple wall sheets 150 of a size smaller than the frame 140 to which they are affixed may be used to provide different colors, designs, or create patterns across the entire wall panel 100 when assembled. When the wall sheets 150*a*, 150*b* are affixed to both sides of the frame 140, the resulting wall panel 100 is hollow inside. This hollow interior may be filled with foam or insulating material to convey insulating properties to the wall panel 100. The hollow interior of the wall panel 100 is also adapted for receiving and conveying cables 220 therethrough, as shown in FIG. 10. Such cables 220 may be any type of cable or wire, such as for electrical power, Internet or ethernet cables, sound or audio-visual cables and the like. The wall panel 100 therefore hides cables 220 that may be needed for lights, sound systems, and other devices that may be used in proximity to the space formed by the wall panels 100 and/or system 200. Utility boxes for plumbing, networking and power, such as outlet boxes and the like, may also be mounted to an interior surface of a wall sheet 150 or to the frame 140 within the hollow formed in the wall panel 100 between wall sheets 150*a*, 150*b*. The connecting plumbing, networking, and power cables, including grounding wires, may be run to the utility box through the frame 140 such as through or between frame components 110 as described below.

Figure 17:
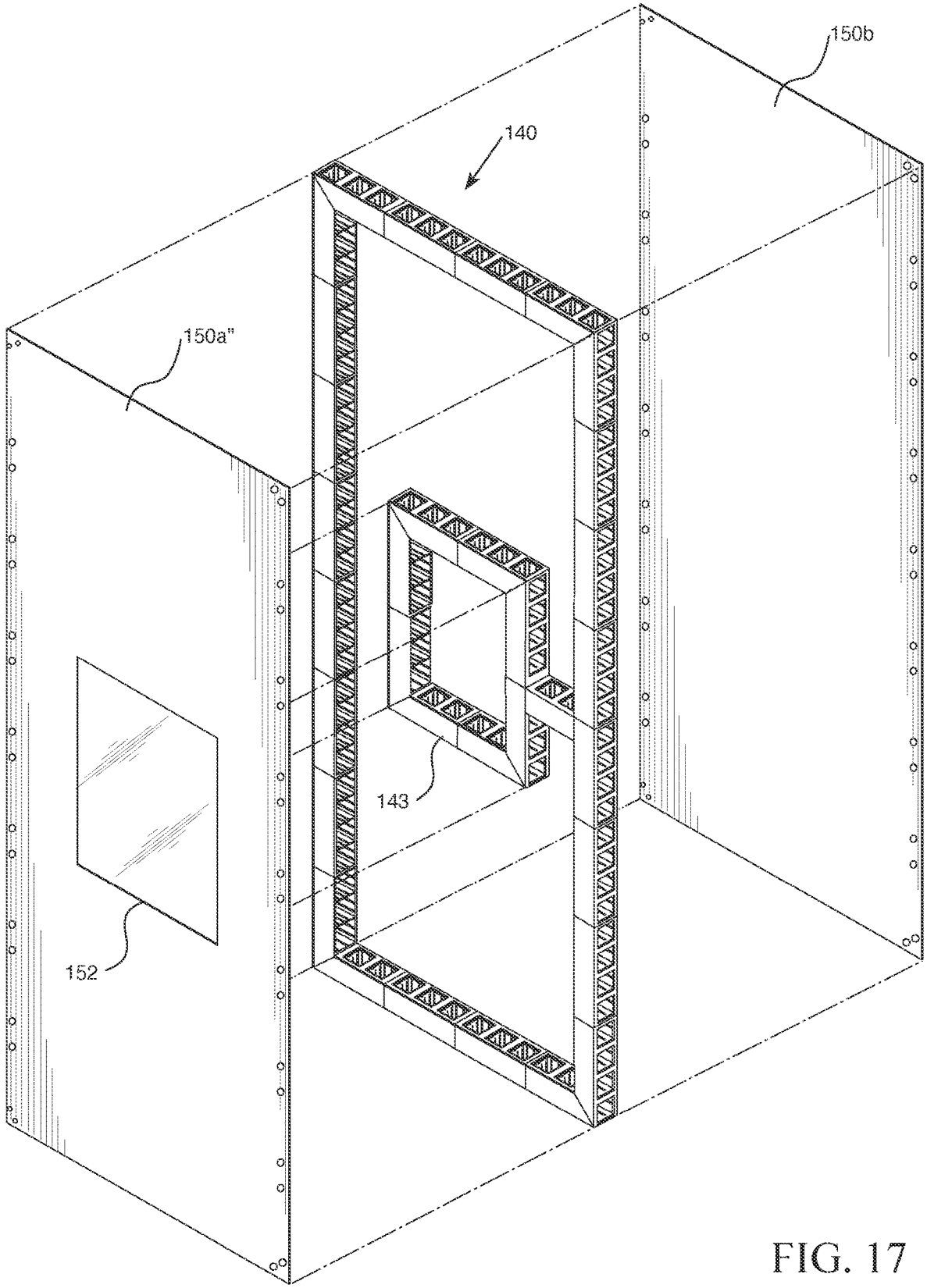
FIG. 17 is an exploded view of another embodiment of a modular wall panel showing a sub-assembly.

With reference to FIGS. 2 and 4-6, the wall panel 100 includes a frame 140 made up of a plurality of frame components 110. As indicated above, the frame 140 forms the skeleton of the wall panel 100, providing the structural support for the wall sheets 150 attached thereto. The frame 140 may be any shape, such as but not limited to rectangular, square, triangular, and others. The frame 140 may also have any configuration, such as intersecting in a radial or grid configuration which may traverse at least a portion of the wall panel 100 and provide support to central portions of the wall sheets 150. Portions of the frame 140 may also form a sub-assembly 143 as shown in FIG. 17 configured to support a feature 152, such as a window, door or screen within a wall sheet 150, as discussed above. In such embodiments, the sub-assembly 143 may have a shape or configuration corresponding to at least a portion of the feature 152. The feature 152 and sub-assembly 143 may be located anywhere on the wall panel 100, though in some embodiments the feature(s) 152 need not be supported by a sub-assembly 143. When present, the sub-assembly 143 may be connected to the remainder of the frame 140 or may be separate from the rest of the frame 140. In at least one embodiment, the frame 140 preferably forms the perimeter, or at least a portion of the perimeter, of each wall panel 100. For instance, the frame 140' in FIG. 4 forms the entire perimeter of the wall panel 100'. In other embodiments, as in FIG. 2, the frame 140 forms only the corners of the wall panel 100.

Any placement or configuration of the frame 140 within the wall panel 100 is contemplated herein. For example, the various frame components 110 that make up the frame 140 may each be contiguous with and touching the next adjacent frame component 110, as in FIG. 4. In other embodiments, only some of the frame components 110 may be touching one another, as in FIG. 2. In some embodiments, some of the frame components 110 may be spaced apart from one another, also as shown in FIG. 2. In still other embodiments, all the frame components 110 may be spaced apart from one another. It should be appreciated that the frame 140 may be formed even when frame components 110 are not contiguous and touching one another. Indeed, the frame components 110 need not be secured or connected to one another to form the frame 140. All that is needed is that they form a support for the wall sheet(s) 150 to affix to. In some embodiments, the frame 140 may be assembled by arranging the frame components 110 on a jig where they "float" until a wall sheet 150 is secured to them, fixing them in place. In such embodiments, complete wall panels 100 may be provided to the end user in the field for assembling into a wall system 200 in the field, as described below. In other embodiments, the frame components 110 may be connected to one another, such as by adhesive, welding, screws, hinges, hook and loop fasteners, and other types of fastening mechanisms, to secure the frame 140 before the wall sheet(s) 150 is affixed thereto. In these embodiments, the frame 140 and walls sheets 150 may be provided to the end user for assembly in the field.

The frame components 110 used in the frame 140 may be any combination of several types but they all have certain elements in common. For instance, and with reference to FIGS. 7-8, the frame components 110 have several wall components 111, such as a first face wall 112 and opposite second face wall 114 that are spaced apart from one another. In at least one embodiment, the first and second face walls 112, 114 are parallel to one another, though in other embodiments they may be other than parallel. Each frame component 110 also includes a first end 116 and second end 118 located at opposite terminal ends of the face walls 112, 114. The ends 116, 118 may be a solid wall, an open space, or a combination thereof. An outer surface 120 spans between the first and second face walls 112, 114, such as extending transversely between corresponding edges of the first and second face walls 112, 114. In at least one embodiment, the outer surface 120 also extends between the first and second ends 116, 118. Accordingly, the outer surface 120 may connect to corresponding edges of the face walls 112, 114 and the ends 116, 118 to cover an entire surface of the frame component 110. An inner surface 122 similarly spans between corresponding edges of the first and second face walls 112, 114 opposite from the outer surface 120. In at least one embodiment, the inner surface 122 may be open to the interior of the frame component 110, as shown in FIG. 8. In other embodiments, the inner surface 122 may be at least partially solid, as is the outer surface 120. Accordingly, the outer and inner surfaces 120, 122, face walls 112, 114 and ends 116, 118 form the boundaries of the frame components 110. Each frame component 110 may measure any dimension, such as but not limited to 12 inches wide (distance from first end 116 to second end 118), 3 inches deep (distance from first face wall 112 to second face wall 114), and 3 inches high (distance from outer surface 120 to inner surface 122).

Figure 7:
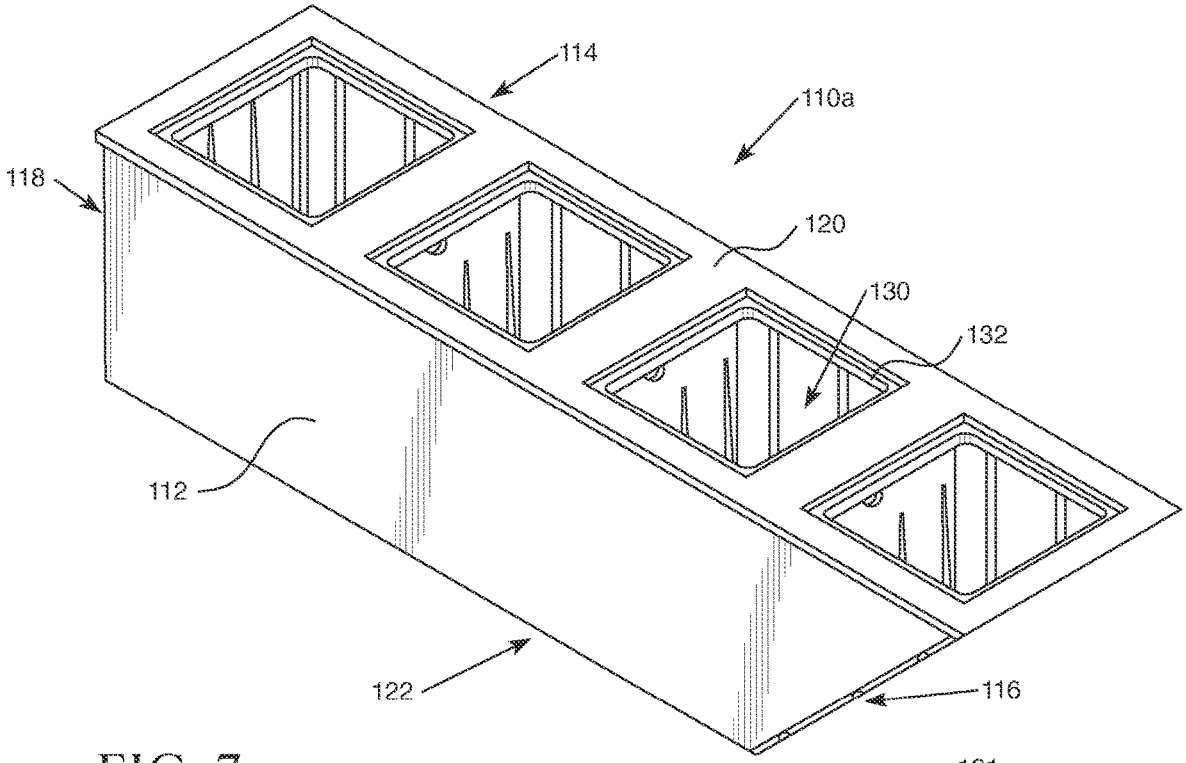
FIG. 7 is a top isometric view of an exemplary frame component as may be used in the modular wall panel.
Figure 8:
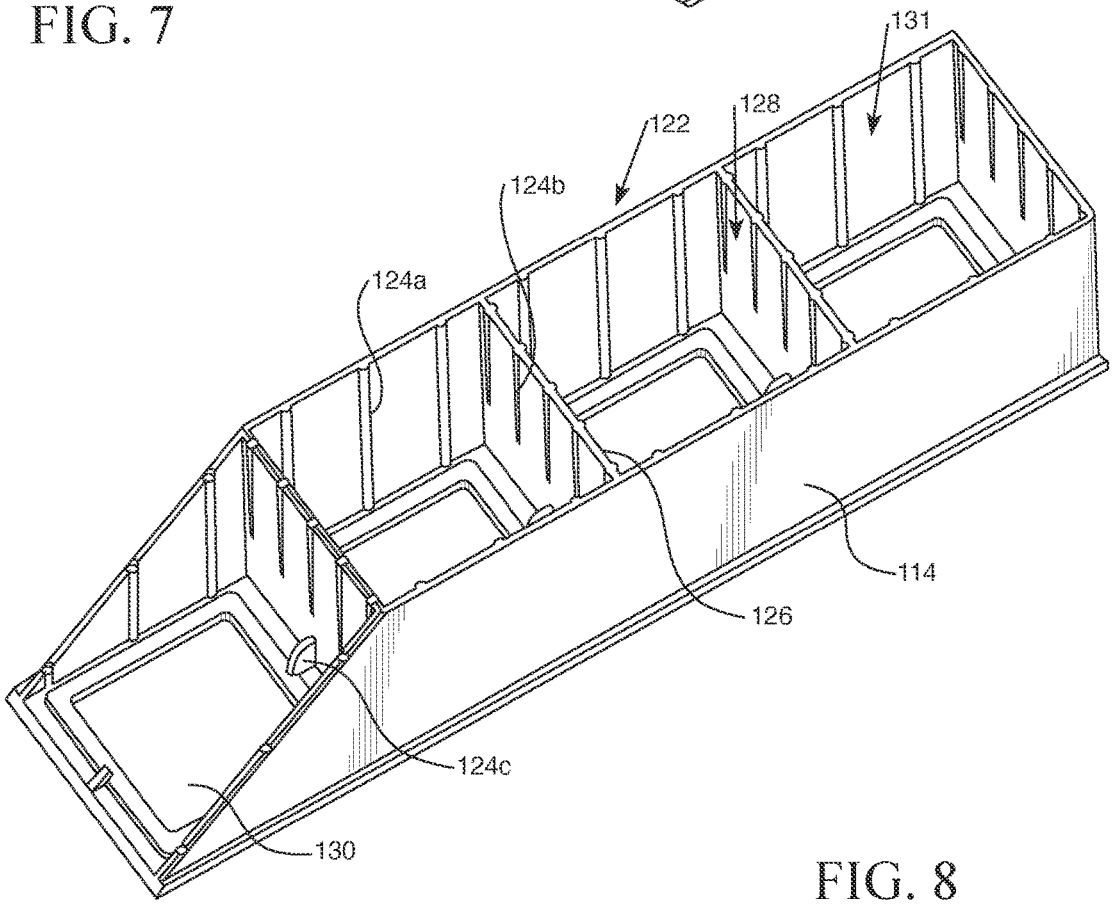
FIG. 8 is a bottom isometric view of the frame component of FIG. 7.

In at least one embodiment, as can be appreciated from FIGS. 7 and 8, the outer surface 120 may extend beyond or over hang the first and second face walls 112, 114 by an amount sufficient to accommodate the wall sheet 150. For instance, the overhang amount may be about the same distance as the thickness of the wall sheet 150 to be affixed to the corresponding face wall 112, 114 that forms the corresponding face 141, 142 of the frame 140 when assembled. By way of example, and not to be limiting, the amount of overhang of the outer surface 120 may be in the range of 0.1-0.11 inches at either face wall 112, 114.

The outer surface 120 includes at least one outer aperture 130 formed therein and spaced apart from one another, as shown in FIG. 7. Each outer aperture(s) 130 has a size and shape large enough to receive and accommodate at least a portion of an insert 155 therein, described in further detail below. For instance, the outer aperture(s) 130 may be square, rectangular, circular, ovoid, or asymmetrically shaped as would correspond with a matching insert 155. In at least one embodiment the outer aperture(s) 130 may measure in the range of 0.5 to 4 inches and may be about 2 inches squared in at least one embodiment. There may be any number of outer aperture(s) 130 in each frame component 110, such as one, three, four, five, ten and twelve as some non-limiting examples. In one embodiment, each frame component 110 may have four outer apertures 130 formed in the outer surface 120.

Similarly, the inner surface 122 includes at least one inner aperture 131 formed therein and spaced apart from one another, as shown in FIG. 8. Each inner aperture(s) 131 also has a size and shape large enough to receive and accommodate at least a portion of an insert 155 therein. In at least one embodiment, each inner aperture 131 is aligned with a corresponding outer aperture 130, forming a passage 128 therebetween. Accordingly, there are preferably the same number of inner apertures 131 as there are outer apertures 130. In at least one embodiment, each corresponding inner and outer aperture 131, 130 may be substantially the same size, shape and dimension. However, in other embodiments the inner aperture(s) 131 may be larger than the corresponding outer aperture(s) 130.

The passage 128 formed between each corresponding outer and inner aperture 130, 131 is dimensioned to receive and also selectively restrain an insert 155 therein. For instance, the frame component 110 may include at least one component wall 111 disposed between the outer and inner surfaces 120, 122 and spaced apart from the ends 116, 118. Such component walls may be a divider(s) 126 which separate adjacent passages 128, as best shown in FIG. 8. Accordingly, the divider(s) 126 may have the same height as the rest of the frame component 110. The divider(s) 126 and other component walls 111, such as the interior-facing sides of the face walls 112, 114 and ends 116, 118, if walls. The divider(s) 126 may have the same or similar thickness as the other component walls 111, such as in the range of about 0.07-0.15 inches. In at least one embodiment, the divider(s) 126 may be thicker or thinner than the outer component walls 111. For instance, the outer component walls 111 may have a thickness in the range of 0.06-0.1 inches. These are a few non-limiting examples for illustrative purposes only.

The frame components 110 may include at least one support rib 124 extending outwardly from a wall 111 or divider 126 in which they are formed. As such, they provide structural support to the corresponding wall 111 or divider 126, and therefore to the wall panel 100 overall. They may also provide frictional engagement with an insert 155 placed within a passage 128 into which a support rib 124 extends. Accordingly, in at least one example the support ribs 124 may extend longitudinally along the interior wall surfaces of the frame component 110, such as between the outer and inner surfaces 120, 122, to be aligned with the direction of insertion and removal of inserts 155 therein. In other examples, however, at least some of the support ribs 124 may extend along the interior wall surfaces of the frame component 110 between adjacent walls which may be other than longitudinal. There may also be different types of support ribs 124. For example, and as depicted in FIG. 8, the frame component 110 may include support ribs **124*a* that extend the entire height of the component walls 111 such as the interior surface of the face walls 112, 114. These full support ribs 124*a* may have a uniform thickness or dimension or may have a varying thickness along its length. Some support ribs 124*b* may be a partial rib that extends only a fraction of the height of the frame component 110. These partial support ribs 124*b* may be tapered, as depicted, or may have a uniform dimension throughout. Other support ribs 124*c* may span between walls, such as between one side of a divider 126 and the underside of the outer surface 120 as shown in FIG. 8. As such, the support ribs 124*c*** may be fins, fans, or other geometric structure to reinforce a junction of walls and provide further support. These are a few non-limiting examples.

As shown in FIGS. 7-8 and 10, the outer surface 120 may also include at least one countersunk portion 132 associated with an outer aperture 130. For example, a countersunk portion 132 may be disposed along at least a portion of the perimeter of an outer aperture 130, such as surrounding a corner(s) of the outer aperture 130 or fully or partially surrounding the outer aperture 130. The countersunk portion 132 is dimensioned to receive a portion of the insert 155 therein. For example, the insert 155 may be a cap 160 having at least one lug portion 162 extending from a cover 166, as described below. The countersunk portion 132 may be dimensioned to receive the cover 166 when the lug portion 162 is received within the corresponding outer aperture 130. In at least one embodiment, the countersunk portion 132 has depth similar in dimension to the thickness of the cover 166, such as but not limited to about 0.075 inches. It may also have a lateral dimension similar to that of the cover 166, which may be wider than the outer aperture 130 into which it is inserted. Accordingly, in at least one embodiment, the countersunk portion 132 provides a planar fit of the cap 160 into the outer aperture 130 such that the cover 166 is substantially co-planar with the surrounding outer surface 120 of the frame component 110 when the cap 160 is placed fully within the outer aperture 130 and passage 128.

Figure 5:
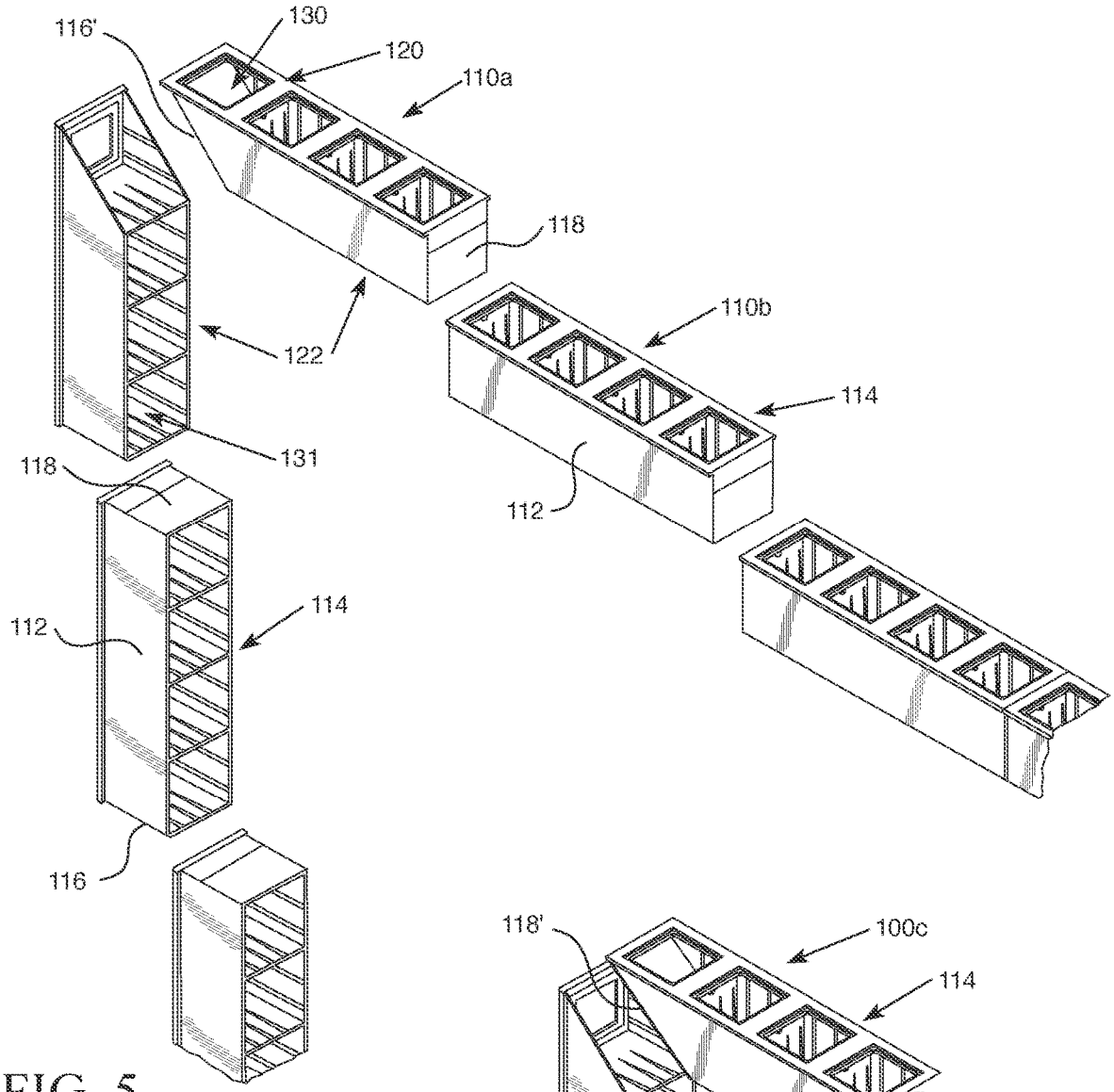
FIG. 5 is an exploded view of an arrangement of frame components of another exemplary embodiment of the modular wall panel.

As mentioned previously, there may be many varieties of frame components 110. For example, the frame component may be a combination frame component **110*a*, as illustrated in FIGS. 7 and 8. Angled frame components 110*a* have one end 118 that is substantially perpendicular to the outer and inner surfaces 120, 122, and one end 116' that is angled relative to the outer and inner surfaces 120, 122. Accordingly, each face wall 112, 114 may have an angled end. The angled end 116' may be at any oblique angle relative to the outer and inner surfaces 120, 122, such as in the range of 10°-80°. In at least one embodiment, the angled end 116' is at a 45° angle relative to the outer surface 120. Two angled frame components 110*a* may be joined together at their angled ends 116' to form a corner of a frame 140, as depicted in FIG. 5**.

Figure 6:
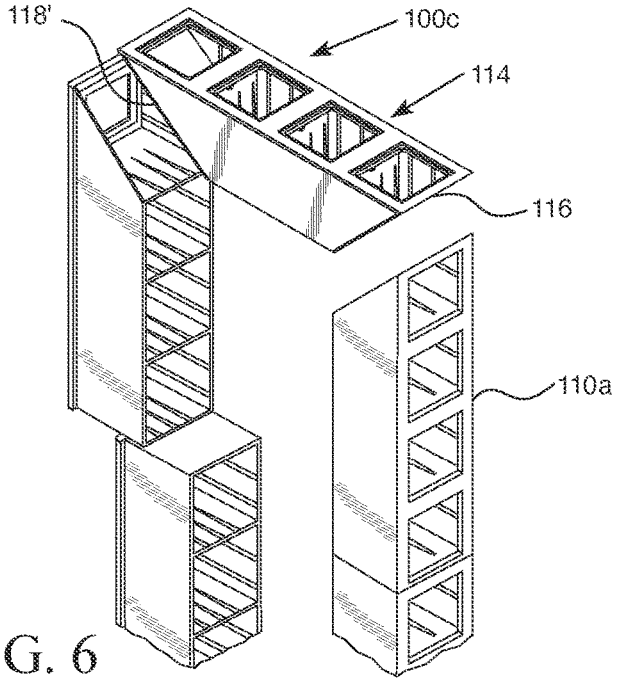
FIG. 6 is an exploded view of an arrangement of frame components of the modular wall panel of FIG. 3.

Other frame components **110*b* have both ends 116, 118 that are substantially perpendicular to the outer and inner surfaces 120, 122. The straight ends 116, 118 may be substantially perpendicular in that some slight deviation from 90° may be tolerated and still considered straight, such as to allow for drafting between adjacent frame components 110***b*. These straight frame components 110*b* may be used to extend the frame 140 in any direction, as shown in FIG. 5. Other frame components 110*c* have both ends 116', 118' that are angled relative to the outer and inner surfaces 120, 122, as depicted in FIG. 6. The angled ends 116', 118' may have the same angle or different angles from one another. In at least one embodiment, both angled ends 116', 118' are about 45° relative to the outer surface 120. Such angled frame components 110*c* may be used to form an end of a frame 140 that is intended to be as narrow as the width of a single frame component, as shown in FIG. 6.

Multiple frame components 110, including any number and combination of the various types discussed above, as may be needed to form a frame 140 of the desired size and/or configuration. The frame components 110 are arranged with their outer surfaces 120 facing away from one another and their inner surfaces 122 facing toward each other, such that the outer apertures 130 are the most exteriorly facing portions of the frame components 110, as shown in FIGS. 1-6 and 10. These outer apertures 130 may provide access into the interior of the wall panel 100 once assembled.

As mentioned previously, the wall panel 100 may also include at least one insert 155 configured to be inserted into an outer aperture 130 of a frame component 110. In at least one embodiment, the insert 155 may be a cap 160 that is configured to cover and/or conceal the outer aperture 130 when inserted therein. As shown in FIGS. 9 and 10, the cap 160 includes at least one lug portion 162 that is configured to be received and retrained within a passage 128 of a frame component 110. Accordingly, the lug portion 162 may be similarly sized and shaped to an outer aperture 130 so as to pass therethrough and a corresponding passage 128 so as to fit within the passage 128. Support ribs 124 extending into the passage 128 may contact the lug portion 162 of the cap 160 when inserted therein, providing increased engagement with the lug portion 162 such as frictional engagement for a tighter or more restrained fit. For instance, the lug portion 162 may measure in the range of 0.1-2.0 inches squared and may be about 1 inch squared in at least one embodiment. It should be appreciated that the lug portion 162, as with the outer aperture 130, need not be square but can be rectangular, circular, ovoid, triangular or other shape. In addition, the lug portion 162 may have a smooth surface or may have ridges, grooves or other elements for increasing the grip or engagement between the lug portion 162 and the passage 128. The lug portion 162 may be the same length, longer or shorter than the passage 128 in which it is retained. For example, in at least one embodiment, the lug portion 162 may have a height in the range of 0.01-1.0 inches and may be about 0.6 inches in at least one embodiment. The lug portion 162 may be solid or hollow throughout, providing more or less rigidity or flexibility as may be required. The lug portion 162 may include some slight angling, such as less than 1°, to allow for drafting or a frictional fit with outer aperture 130 and/or passage 128, though this is not necessary.

The cap 160 also includes a cover 166 dimensioned to be at least as, though preferably larger than, the size of an outer aperture 130. Accordingly, the lug portion 162 may be inserted through the outer aperture 130 and into the corresponding passage 128 up until the point the cover 166 stops against the outer surface 120 surrounding the outer aperture 130. As explained above, the cover 166 may be correspondingly dimensioned to a countersunk portion 132 around the outer aperture 130 so as to cover or conceal the outer aperture 130 in a substantially planar manner. Indeed, the cover 166 may be flush with the outer surface 120 surrounding the outer aperture 130 when the cover 166 is fully within the countersunk portion 132 and the cap 160 is fully seated. Accordingly, the cover 166 may extend past the outer aperture 130 by a predetermined distance which may correspond with the countersunk portion 132, such as by a distance in the range of 0.05-0.5 inches and may be about 0.22 inches in at least one embodiment. When desired, the cap 160 may be removed from the passage 128 and outer aperture 130.

Figure 11:
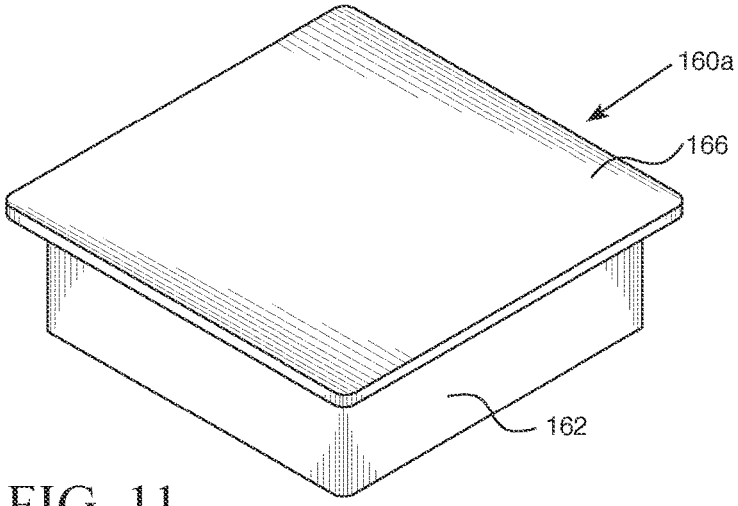
FIG. 11 is an isometric view of one embodiment of a cap as may be used with the modular wall panels and/or system.
Figure 12:
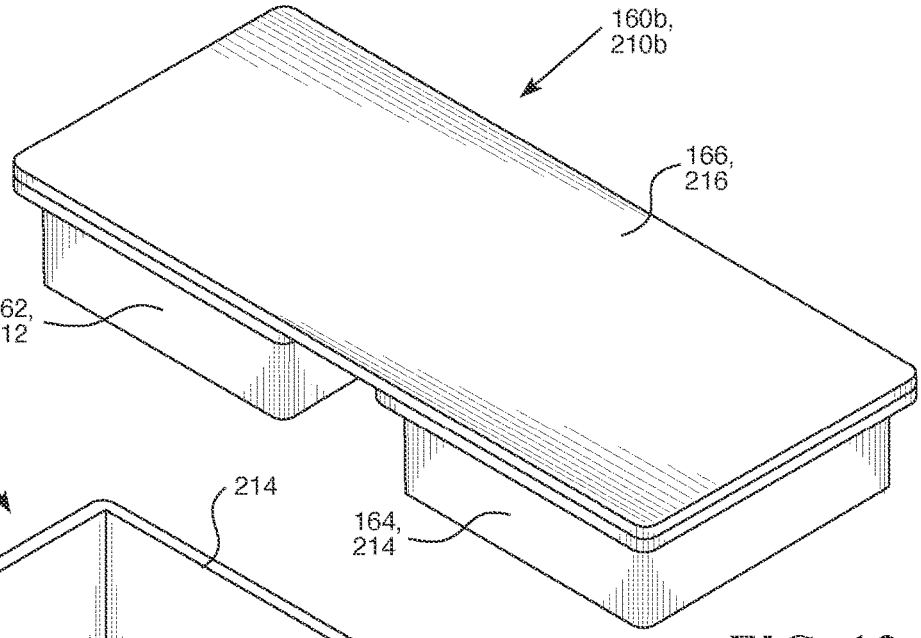
FIG. 12 is an isometric view of a second embodiment of a cap and is also an embodiment of a planar connector.

The cap 160 may come in many varieties. For example, it may be a single cap 160*a* as shown in FIG. 11, which includes a single lug portion 162 extending from the cover 166, and which is intended to fill in and conceal a single outer aperture 130. However, in some embodiments a single cap 160*a* may have a single lug portion 162 but an extended cover 166 to cover more than one outer aperture 130 despite only one outer aperture 130 being filled. The cap 160 may also be a double cap 160*b*, as shown in FIG. 12, which includes a plurality of lug portions, such as a first lug portion 162 and a second lug portion 164 spaced apart from one another and both extending from the cover 166. Accordingly, the cover 166 may have a longer dimension in a double cap 160*b* than a single cap 160*a*. In a double cap 160*b*, each lug portion 162, 164 is dimensioned to be received and retained within different and adjacent ones of outer apertures 130. Accordingly, more than one outer aperture 130 may be covered or concealed with a double cap 160*b*. The distance between the first and second lug portions 162, 164 is therefore the same distance that separates adjacent outer apertures 130. In further embodiments, the cap 160 may be a triple, quadruple, etc., adding an additional lug portion for each additional outer aperture 130 to be concealed. It should be appreciated that with a double cap 160*b* or more, or with a single cap 160*a* having an extended cover 166, the cover 166 may exceed the boundaries of a countersunk portion 132 at an outer aperture 130. Accordingly, the cover 166 may not sit flush or co-planar with the outer surface 120 of the frame component 110 when a larger cap 160*b* spanning multiple outer apertures 130 is used.

The caps 160 may be used to conceal the outer apertures 130 and any combination of single and multiple caps 160 may be used on a wall panel 100. However, it is not necessary to fill and/or conceal all the outer apertures 130. In at least one embodiment, at least some of the outer apertures 130 may remain open for access to cables or the interior of the wall panel 100. The caps 160 also provide further support to the frame components 110, and therefore the frame 140, when they are inserted into the outer apertures 130. Accordingly, the caps 160 may help prevent the wall panel 100 from tipping over or falling. In particular, a double cap 160*b* may be useful along the bottom of a wall panel 100 to help it stand up since the double cap 160*b* does not countersink into the frame components 110. They may also be used at the top side of the wall panel 100 where they are not as likely to be visible.

Figure 16:
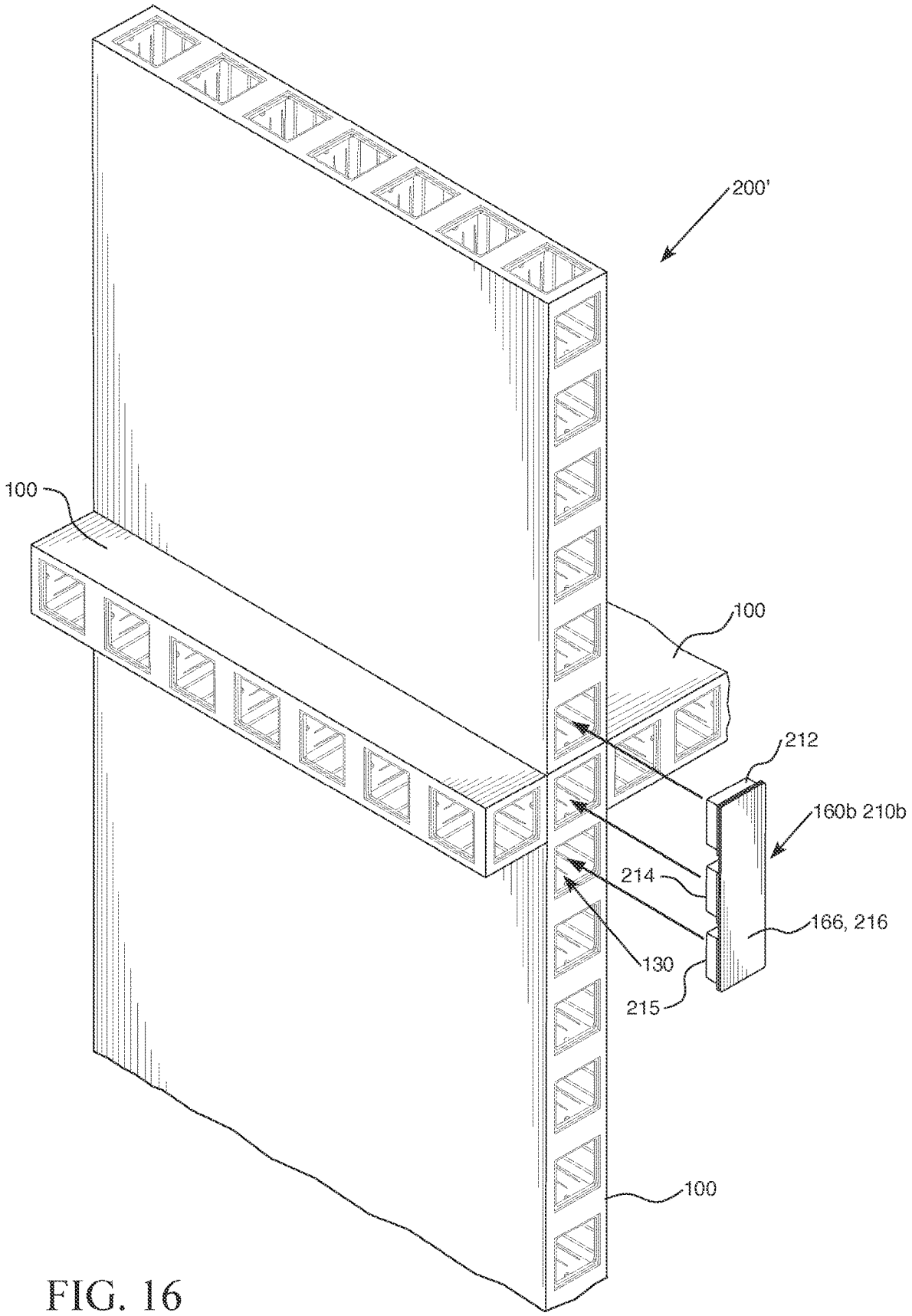
FIG. 16 is an isometric, partially exploded view of another embodiment of a modular wall system of the present invention showing intersecting walls.

The present invention is also directed to a wall system 200 that includes a plurality of wall panels 100 as described above connected to one another with one or more connectors 210. The wall system 200 may be assembled in the field by connecting wall panels 100 together laterally and/or vertically to cover any space or height desired. With reference to FIGS. 9, 10 and 16, the wall system 200 may include any number, combination and configuration of wall panels 100 as discussed above. The wall panels 100 may be connected to adjacent wall panels 100 at their respective outer surfaces 120. Specifically, the wall system 200 includes at least one connector 210 configured to selectively connect adjacent wall panels 100 through the frame components 110. The connector 210 is another type of insert 155 configured to be received by an outer aperture 130 of a frame component 110. Each connector 210 includes a first lug portion 212 configured to be received and retained in an outer aperture 130 and/or passage 128 of one wall panel 100 and a second lug portion 214 configured to be received and retained in an outer aperture 130 and/or passage 128 of an adjacent wall panel 100. Each lug portion 212, 214 of a connector 210 is similar to the lug portions 162, 164 of the caps 160 discussed above. Any number of connectors 210 may be used to connect adjacent wall panels 100 to one another, and they may interact with at least some of the frame components 110 and at least some of the outer apertures 130 thereof.

Figure 15:
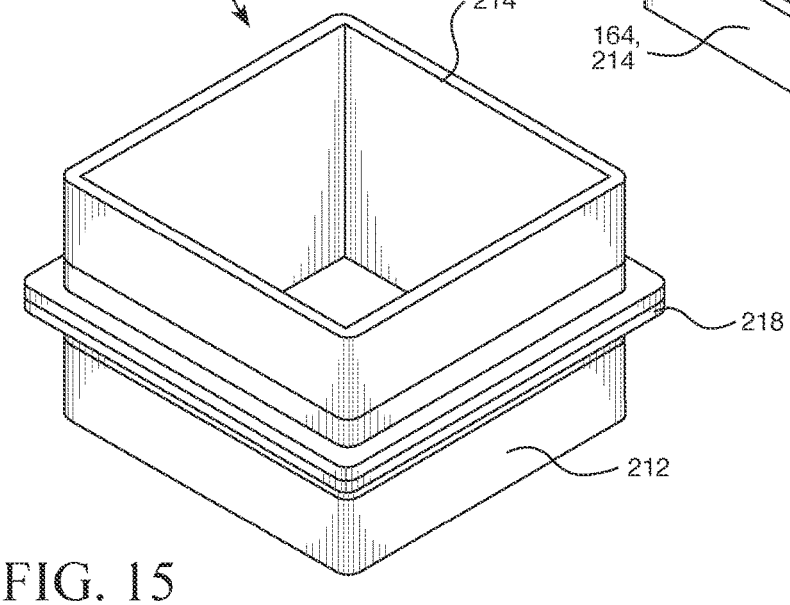
FIG. 15 is an isometric view of an embodiment of a bi-directional connector.

There are multiple types of connectors 210. For example, the connector may be a bi-directional connector 210*a* as shown in FIGS. 10 and 15. The bi-directional connector 210*a* has a flange 218 along at least a portion thereof. In at least one embodiment, the flange 218 extends substantially around the circumference or perimeter of the bi-directional connector 210*a*. First and second lug portions 212, 214 extend from opposite sides of the flange 218. Each of the first and second lug portions 212, 214 are dimensioned to fit and be selectively retained within a different outer aperture 130 on different wall panels 100. The flange 218 between the lug portions 212, 214 may be at least the dimensions of an outer aperture 130 of a frame component 110. In at least one embodiment, the flange 218 may be dimensioned to correspond with a countersunk portion 132 associated with an outer aperture 130 of a frame component 110. Accordingly, the flange 218 may be received within a countersunk portion 132 of at least one, if not both, wall panels 100 being joined together with the bi-directional connector 210*a*. Accordingly, the bi-directional connector 210*a* provides a tight fit between adjacent wall panels 100, forming only a very thin seam. This increases the structural integrity of the wall system 200 as well as the aesthetics.

Another type of connector is a planar connector 210*b*, an example of which is shown in FIGS. 10 and 12. The planar connector 210*b* includes a plurality of lug portions, such as first and second lug portions 212, 214 as described above, but which extend from the same side of a cover 216. Indeed, the double cap 160*b* discussed above may also function as a planar connector 210*b*. When acting as a connector, one lug portion 212 of the planar connector 210*b* is received within a frame component 110, such as an outer aperture 130, of one wall panel 100, and the other lug portion 214 of the planar connector 210*b* is received within a frame component 110 or outer aperture 130 of an adjacent wall panel 100. The planar connector 210*b* may have two, three, four, or more lug portions 212 all extending from the same or common side of a cover 216. Accordingly, the size of the cover 216 will increase with additional lug portions 212 present.

Figure 13:
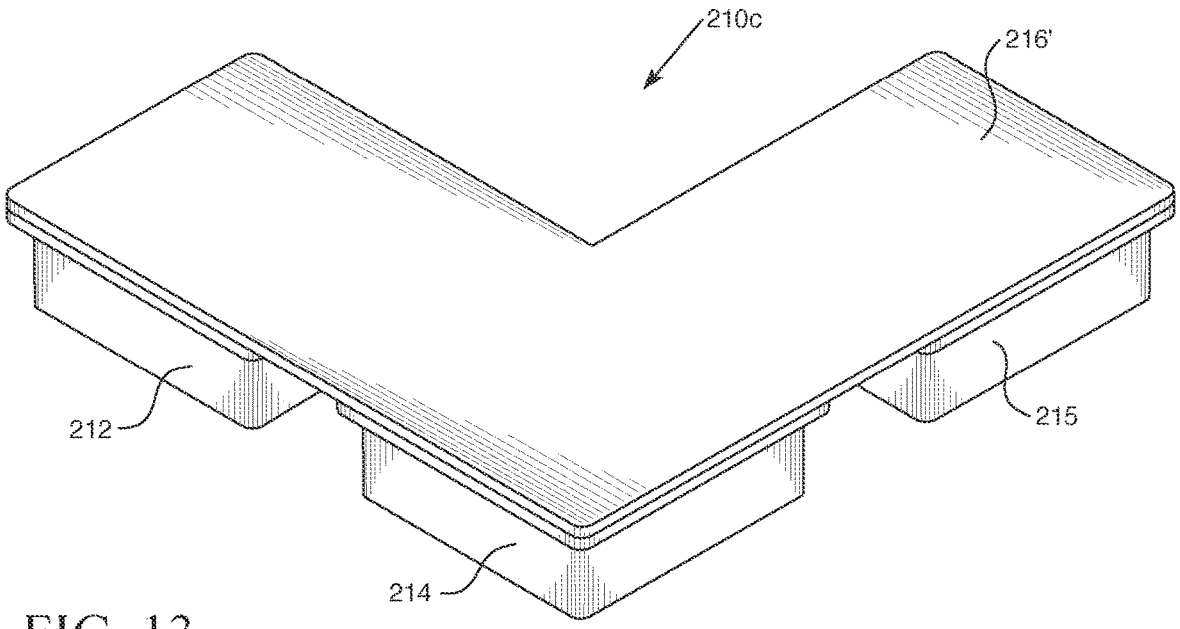
FIG. 13 is an isometric view of a second embodiment of a planar connector, being L-shaped.
Figure 14:
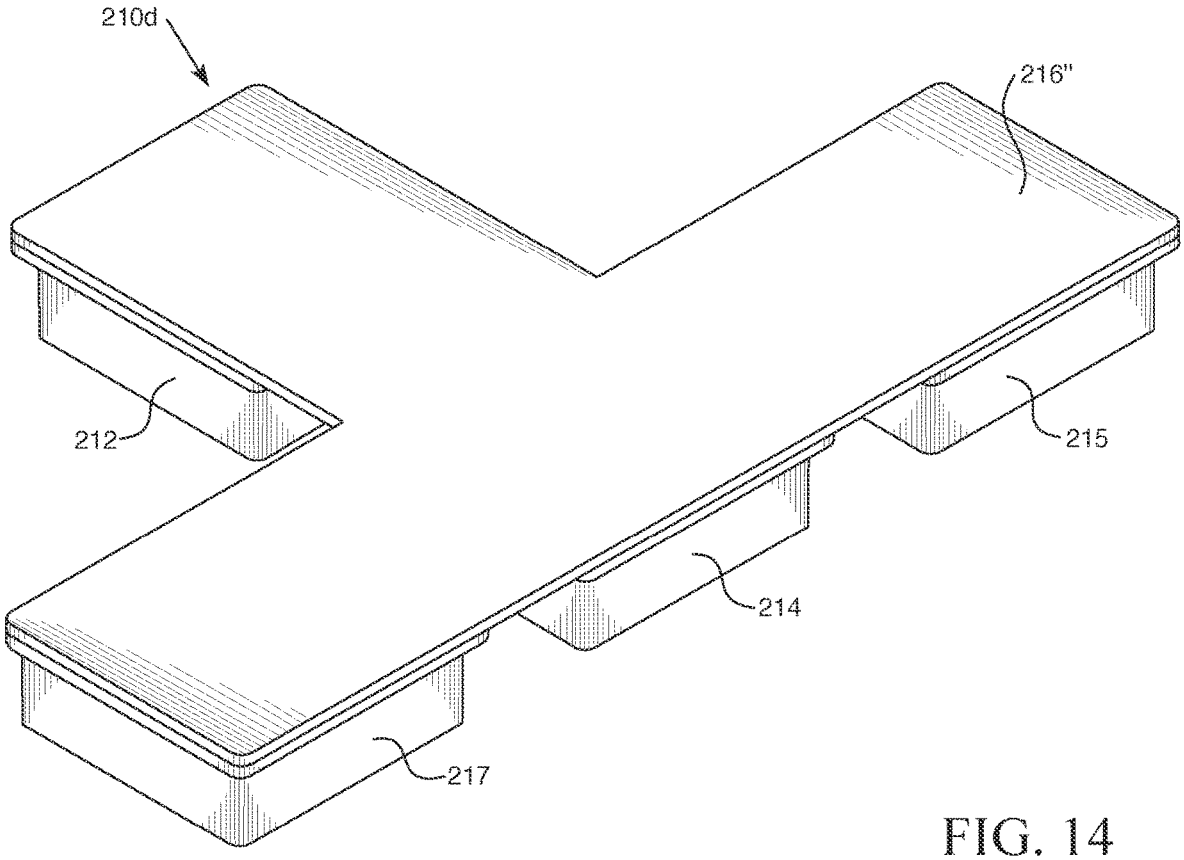
FIG. 14 is an isometric view of a third embodiment of a planar connector, being T-shaped.

The planar connector 210*b* may come in various configurations. For example, the planar connector 210*b* may be linear in shape, with the length of the connector 210*b* dictated by the number of lug portions 212 it contains. In other examples, the planar connector may have an intersecting configuration to accommodate intersecting or transversely connecting wall panels 100, such as an L-shaped connector 210*c* shown in FIG. 13 and a T-shaped connector 210*d* shown in FIG. 14. The L-shaped connector 210*c* may have at least three lug portions 212, 214, 215 extending from a common side of a cover 216', each spaced apart from one another and configured to fit within a different outer aperture 130, at least two of which are on different frame components 110 of different wall panels 100. Similarly, the T-shaped connector 210*d* may have at least four lug portions 212, 214, 215, 217 each extending from a common side of a cover 216", each spaced apart from one another and configured to fit within a different outer aperture 130, at least two of which are on different frame components 110 of different wall panels 100. Any leg of the L-shaped connector 210*c* or T-shaped connector 210*d* may be longer if it has additional lug portions.

To assemble the wall system 200, two wall panels 100 are joined together along their outer surfaces 120 of the frame components 110 of their frames 140, such as shown in FIGS. 10 and 16. These adjacent panels may be joined to one another by sandwiching a bi-directional connector 210*a* therebetween. Specifically, a first lug portion 212 of the connector 210*a* is inserted into an outer aperture 130 of one wall panel 100 and the opposite second lug portion 214 is inserted into an outer aperture 130 of another wall panel 100 brought adjacent to the first. The flange 218 of the bi-directional connector 210*a* is disposed between the joining frames 140, and in at least one embodiment may sit at least partially in the countersunk portions 132 of adjacent outer apertures 130 being joined.

Adjacent wall panels 100 may also be connected by bridging a planar connector 210*b* across the panels 100 exterior to the outer surfaces 120 of the frames 140. To accomplish this, the first lug portion 212 is inserted into an outer aperture 130 of one wall panel and the second lug portion 214 is inserted into an outer aperture 130 of an adjacent wall panel 100, as shown in FIG. 10. In some embodiments, the wall system 200' may include intersecting panels 100, as in FIG. 16, or transversely connecting panels 100 where one or more wall panels 100 terminates at another transverse wall panel 100 such as in a T-shaped configuration. In either of these additional embodiments, the wall panels 100 may be at an angle relative to one another, such as but not limited to 90°, and may be connected with an L-shaped connector 210*c*, T-shaped connector 210*d*, or linear planar connector 210*b* having two or three lug portions by inserting a centrally-located lug portion into the outer aperture 130 at the intersection of the wall panels 100 and the remaining lug portions into their corresponding adjacent outer apertures 130 of the wall panels 100, such as shown in FIG. 16. The planar connectors 210*b*, 201*c*, 210*d* may be inserted into outer apertures 130 located along the top surfaces of the wall panels 100 to hide them from view and/or along the bottom surfaces of the wall panels 100 to provide additional support to the wall system 200' and keep the wall system 200' from tipping over.

Figure 18:
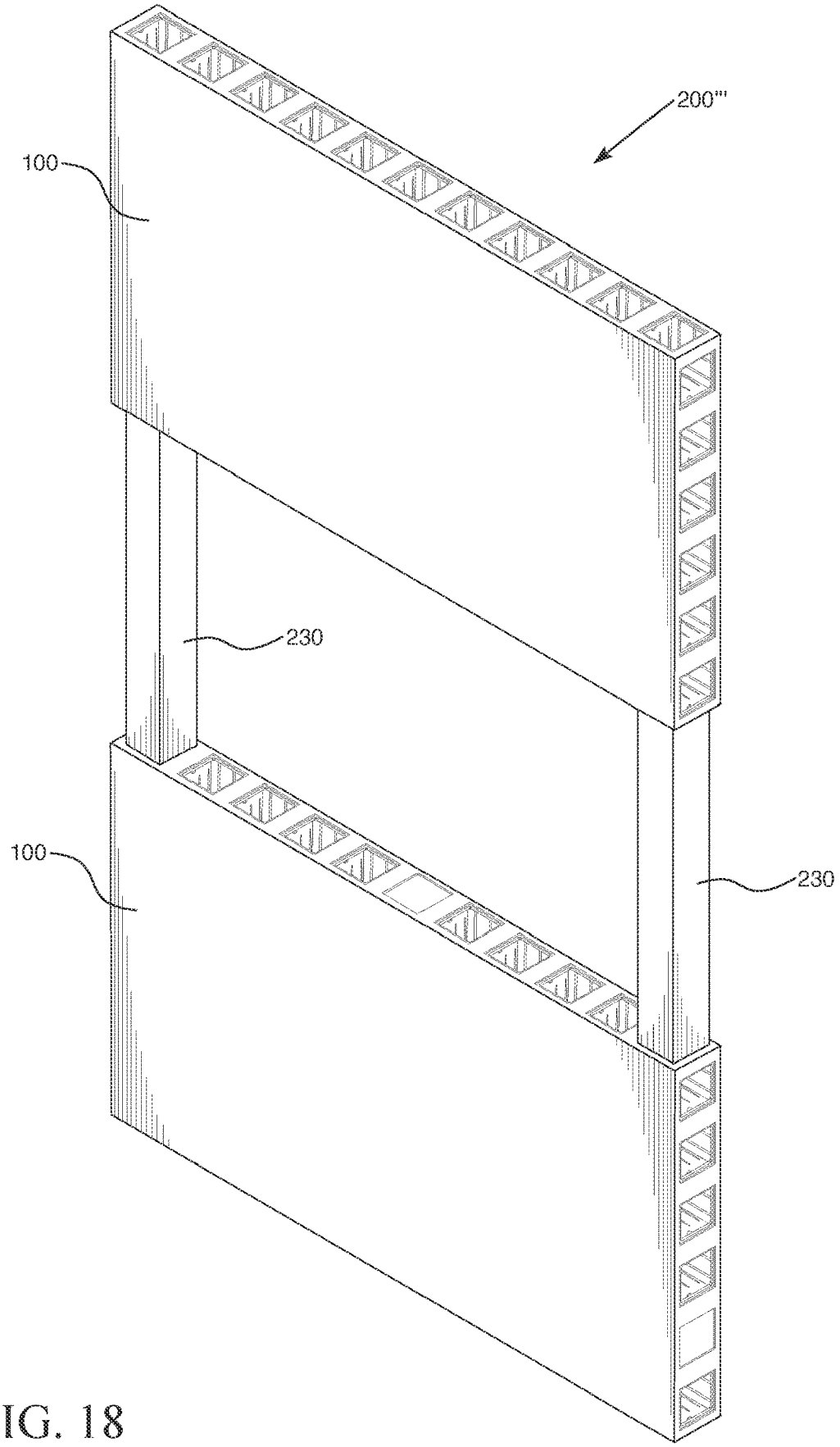
FIG. 18 is an isometric view of another embodiment of a wall system showing spaced apart wall panels.

In still other embodiments, the insert 155 may include a spacer 230, such as shown in FIG. 18, which may be used to assemble a spaced apart configuration of wall system 200". The spacer 230 may be similar to a lug portion 162, 212 of a cap 160 or connector 210 as described above but differs in length. The spacer 230 may therefore also be configured to be received and retained within an outer aperture 130 and/or passage 128 of a frame component 110 but has a length longer than that of the lug portion 162, 212 of a cap 160 or connector 210. In at least one embodiment, the spacer 230 may be longer than the length of the passage 128. The spacer 230 is configured to connect different wall panels 100 and hold them in a spaced apart relation to one another, rather than contacting or abutting one another. In some embodiments, the spacer 230 may be a rod, bar or other similarly elongate member such as shown in FIG. 18. Such embodiments may be particularly useful in creating larger spaces between wall panels 100 within an system 200". In other embodiments, however, the spacer 230 may be planar connector 210*b*, 210*c*, 210*d* having at least some lug portions 212, 214, etc. spaced further apart than the spacing of outer apertures 130 in adjoining frame components 110 such that proximate wall panels 100 may be connected despite a small space maintained between them. The same may be accomplished by a bi-directional connector 210*a* having longer lug portions 212, 214 on either side of the flange 218 such that the entire length of the lug portions 212, 214 do not fit within the passage 128. In such above manners, wall systems 200, 200', 200" may be built to any size, shape, configuration as desired and is therefore entirely customizable.

Cables 220 may be run through the frame components 110 between adjacent wall panels 100, such as through the outer apertures 130, inner apertures 132 and passages 128. The cables 220 may therefore also run through the bi-directional connectors 210*a* that join adjacent wall panels 100. Of course, cables 220 may also be run between frame components 110, such as when frame components 110 are not contiguous the cables 220 may be run in the space between. When all the cables 220 are run, any empty outer apertures 130 may be filled with a cap 160, if desired, though not every outer aperture 130 needs to be capped.

The wall system 200, 200', 200" may also be easily disassembled when desired, such as at the end of event, to remodel office space, or to update the configuration or options of the system 200, 200', 200". To disassemble, the steps are simply reversed, with the wall panels 100 being able to be pulled away from the lug portions 212, 214 of the connectors 210, the caps 160 and spacers 230 removed, and the cables 220 pulled back through. The components of the wall system 200 may be easily transported to another site for reassembly.

Since many modifications, variations and changes in detail can be made to the described preferred embodiments, it is intended that all matters in the foregoing description and shown in the accompanying drawings be interpreted as illustrative and not in a limiting sense. Thus, the scope of the invention should be determined by the appended claims and their legal equivalents. Now that the invention has been described,

What is claimed is:

1. A wall frame component for assembling an exterior frame of a modular wall panel having an interior space at least partially defined by said exterior frame, said wall frame component selected from the group consisting of:

(i) a straight frame component having:

a pair of face walls spaced apart from one another;

a pair of end walls spaced apart by said face walls and affixed at terminal ends thereto;

an outer surface extending transversely between and substantially perpendicular to corresponding edges of said face walls and corresponding edges of said end walls, said outer surface forming an exterior boundary of said exterior frame and disposed at a perimeter of said modular wall panel when assembled;

an inner surface opposite and spaced apart from said outer surface, said inner surface forming an interior boundary of said exterior frame and at least partially defining an interior space of said modular wall panel between said inner surface of different ones of said frame components collectively forming said exterior frame when assembled;

at least one outer aperture extending through said outer surface;

at least one inner aperture extending through said inner surface; and a passage formed between said at least one outer aperture and said at least one inner aperture, said passage configured to provide ingress and egress to said interior space of said wall panel through an exterior edge of said exterior frame at a perimeter of said modular wall panel and between respective interior spaces of adjacent joined modular wall panels, said passage further configured to receive an insert therein;

(ii) an angled frame component having:

a pair of face walls spaced apart from one another, each of said face walls having angled ends on both sides;

an outer surface extending transversely between corresponding edges of said face walls and at an oblique angle relative to said angled ends, said outer surface forming an exterior boundary of said exterior frame and disposed at a perimeter of said modular wall panel when assembled;

an inner surface opposite and spaced apart from said outer surface, said inner surface forming an interior boundary of said exterior frame and at least partially defining an interior space of said modular wall panel between said inner surface of different ones of said frame components collectively forming said exterior frame when assembled;

at least one outer aperture extending through said outer surface;

at least one inner aperture extending through said inner surface; and a passage formed between said at least one outer aperture and said at least one inner aperture, said passage configured to provide ingress and egress to said interior space of said wall panel through an exterior edge of said exterior frame at a perimeter of said modular wall panel and between respective interior spaces of adjacent joined modular wall panels, said passage further configured to receive an insert therein; and (iii) a combination frame component having:

a pair of face walls spaced apart from one another each having an angled end on one side and a straight end on the opposite side;

an end wall extending between said corresponding straight ends of said pair of face walls;

an outer surface extending transversely between and substantially perpendicular to a corresponding edge of said face walls and at an oblique angle relative to said angled end, said outer surface forming an exterior boundary of said exterior frame and disposed at a perimeter of said modular wall panel when assembled;

an inner surface opposite and spaced apart from said outer surface, said inner surface forming an interior boundary of said exterior frame and at least partially defining an interior space of said modular wall panel between said inner surface of different ones of said frame components collectively forming said exterior frame when assembled;

at least one outer aperture extending through said outer surface;

at least one inner aperture extending through said inner surface; and a passage formed between said at least one outer aperture and said at least one inner aperture, said passage configured to provide ingress and egress to said interior space of said wall panel through an exterior edge of said exterior frame at a perimeter of said modular wall panel and between respective interior spaces of adjacent joined modular wall panels, said passage further configured to receive an insert therein.

2. The wall frame component of claim 1, wherein at least one of said face walls and said end walls includes at least one support rib extending therefrom toward said interior space, said at least one support rib configured to at least one of (i) provide structural support to said wall frame component and (ii) provide frictional engagement with a portion of said insert.

3. The wall frame component of claim 1, further comprising at least one divider extending from said outer surface and between said pair of face walls, said at least one divider at least partially defining said passage extending from said at least one aperture.

4. The wall frame component of claim 3, wherein said at least one divider includes at least one support rib extending therefrom toward said passage.

5. The wall frame component of claim 1, further comprising a countersunk portion at least partially surrounding said at least one aperture.

6. The wall frame component of claim 1, wherein said insert is a cap including (i) a lug portion dimensioned to be received in one of said at least one outer aperture and selectively retained within said passage and (ii) a cover having a larger dimension than said at least one outer aperture, said cap configured to substantially block said outer aperture when said lug portion is retained within said passage.

7. The wall frame component of claim 6, further comprising a countersunk portion associated with said at least one outer aperture and correspondingly dimensioned to receive said cover of said cap.

8. The wall frame component of claim 6, wherein said cap further comprising a plurality of lug portions each extending from said cover and spaced apart from one another, each of said plurality of lug portions configured to be received and selectively retained within different ones of said at least one outer aperture.

9. The wall frame component of claim 8, wherein each of said plurality of lug portions is configured to be received and selectively retained within different ones of said at least one outer aperture on different ones of said frame components.

* * * * *